US010625140B1

(12) United States Patent
Winston

(10) Patent No.: US 10,625,140 B1
(45) Date of Patent: Apr. 21, 2020

(54) REDUCED FRICTION UNDER-SIDE OF A SKATEBOARD TO MITIGATE WHEEL BITE

(71) Applicant: Deric Winston, Hillsborough, NJ (US)

(72) Inventor: Deric Winston, Hillsborough, NJ (US)

( * ) Notice: Subject to any disclaimer, the term of this patent is extended or adjusted under 35 U.S.C. 154(b) by 0 days.

(21) Appl. No.: 16/377,277

(22) Filed: Apr. 8, 2019

Related U.S. Application Data

(60) Provisional application No. 62/659,681, filed on Apr. 18, 2018.

(51) Int. Cl.
*A63C 17/01* (2006.01)
*A63C 17/00* (2006.01)

(52) U.S. Cl.
CPC ..... *A63C 17/0006* (2013.01); *A63C 17/017* (2013.01)

(58) Field of Classification Search
CPC .. A63C 17/0006; A63C 17/017; A63C 17/002
See application file for complete search history.

(56) References Cited

U.S. PATENT DOCUMENTS

2008/0210374 A1* 9/2008 Yatsko ..... B32B 7/06 156/327
2014/0131149 A1* 5/2014 Chang ..... F16D 65/18 188/73.44

OTHER PUBLICATIONS

Wheel Shields. Undated. 1 page.

* cited by examiner

*Primary Examiner* — Bryan A Evans
(74) *Attorney, Agent, or Firm* — Joseph E. Maenner; Maenner & Associates, LLC

(57) ABSTRACT

This invention provides the novel application of securing a low friction polymer, such as, for example, UHMWPE as the exemplary embodiment, with a coefficient of friction of less than about 0.15, which has adjustable margins for length, height, and width, on the bottom of a skateboard, between the bottom of the skateboard and the wheels with the purpose of mitigating the problem of wheel bite in skateboarding. This piece may have a flat or shaped, concave surface, and can be attached to the skateboard with an adhesive, by embedding the material in the skateboard, or by other known methods.

17 Claims, 10 Drawing Sheets

REDUCED FRICTION UNDER-SIDE OF A SKATEBOARD TO MITIGATE WHEEL BITE

CROSS-REFERENCE TO RELATED APPLICATION

The present application claims priority from U.S. Provisional Patent Application Ser. No. 62/659,681, filed on Apr. 18, 2018, which is incorporated herein by reference in its entirety.

BACKGROUND OF THE INVENTION

One problem in skateboarding that does not yet have an effective solution is wheel bite. Wheel bite, depicted in FIG. 1, occurs when the bottom of the skateboard comes into contact with one of the wheels, causing the wheel to lock and the skateboarder to fall, often resulting in injury. There have been a number of attempts at solving this problem, such as riser pads, which increase the space between the board and the wheels, pivoting axle trucks, which pivot away from the board to prevent the wheel from coming into contact with the board, wheel cutouts, where a hole is cut out of the skateboard, and wax, which is applied underneath the board.

However, each of these solutions brings along its own set of new problems. Riser pads and truck adjustments compromise board control; wheel cutouts are simply not ideal, as it is undesirable to have holes cutout of one's skateboard; and wax rubs off on the wheels, creating traction problems. But if a skateboarder does nothing, he/she risks experiencing wheel bite and unexpectedly being thrown from his/her skateboard. Therefore, a need exists in skateboarding for an effective solution to the problem of wheel bite, without creating additional problems.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The present invention provides a low friction polymer, such as ultra high molecular weight polyethylene ("UHMWPE") as an exemplary embodiment applied underneath the skateboard, between the bottom of the board and the wheel. In the event that the skateboarder would normally experience wheel bite, the wheel will instead come into contact with the low friction polymer, such as UHMWPE, where its low-friction and high abrasion resistance will reduce the effect of the wheel bite, allowing the skateboarder to remain on the board. This piece may have either a flat surface, or a shaped, concave surface to better conform to the wheels. This invention can be applied as an attachment to the skateboard, embedded in the skateboard, or as part of the skateboard.

BRIEF DESCRIPTION OF DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF INVENTION

Figure 1:
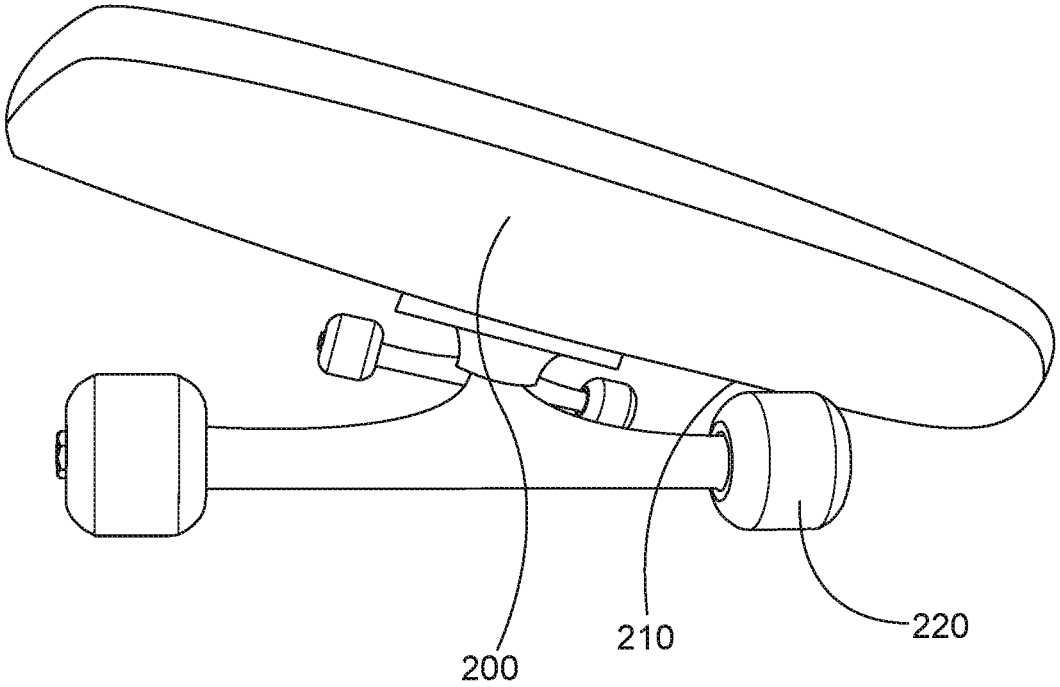
FIG. 1 (PRIOR ART)
FIG. 1 demonstrates the problem of wheel bite that is to be solved by this invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

Low-friction tapes, films, plastics, and polymers, particularly Ultra-High Molecular Weight Polyethylene ("UHMWPE"), have been used widely in many different applications to facilitate sliding, or where a low-friction surface is required. An advantage of UHMWPE is that UHMWPE provides a low-friction surface along with high abrasion resistance, without rubbing off any oily or waxy residue. These characteristics are precisely what are needed in a solution to wheel bite in skateboarding, but low-friction polymers have never been applied in this way. A low friction polymer, such as UHMWPE tape or film, as the exemplary embodiment, applied between the bottom of the skateboard and the wheel provides an effective and durable solution to wheel bite without creating any undesirable externalities.

Figure 3:
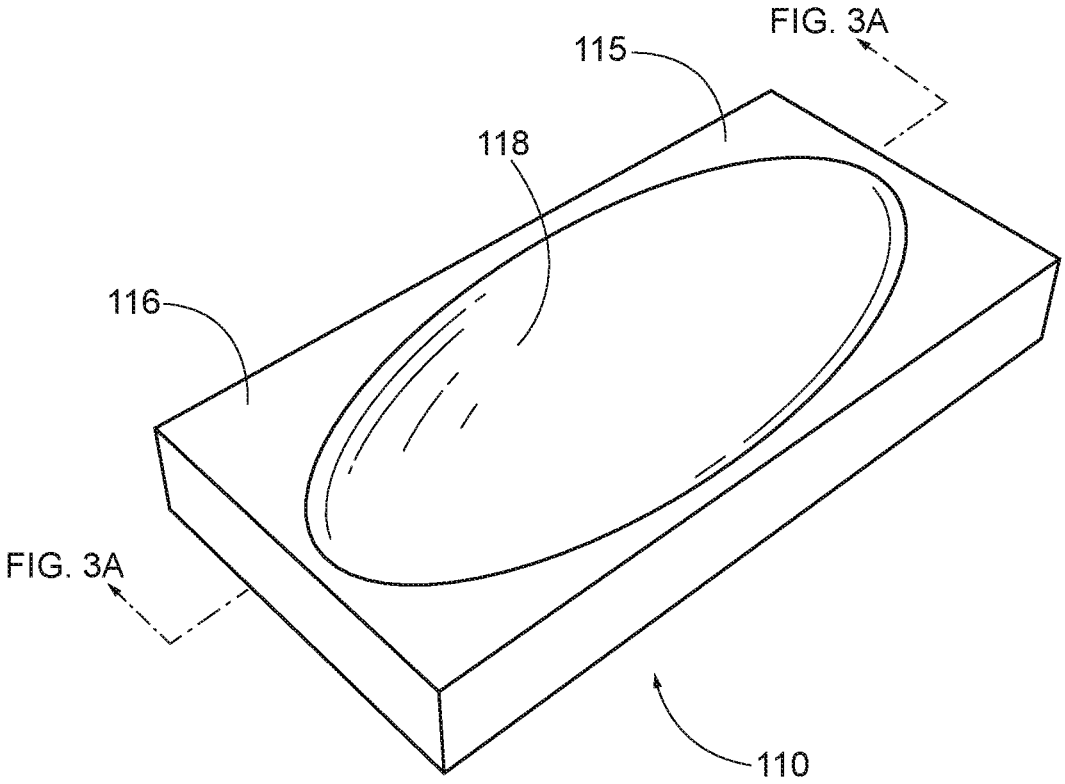
FIG. 3 depicts a perspective view of a low friction material according to an alternative exemplary embodiment of the present invention.
Figure 3A:
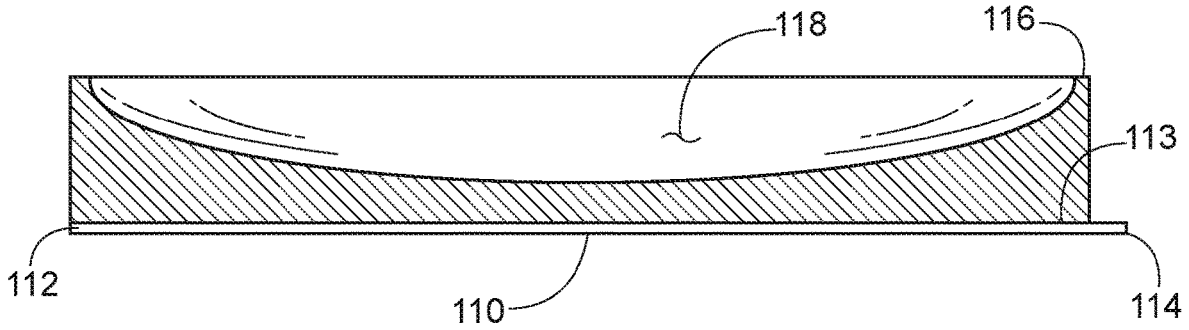
FIG. 3A shows a sectional view of FIG. 3 taken along lines 3A-3A of FIG. 3.
Figure 4:
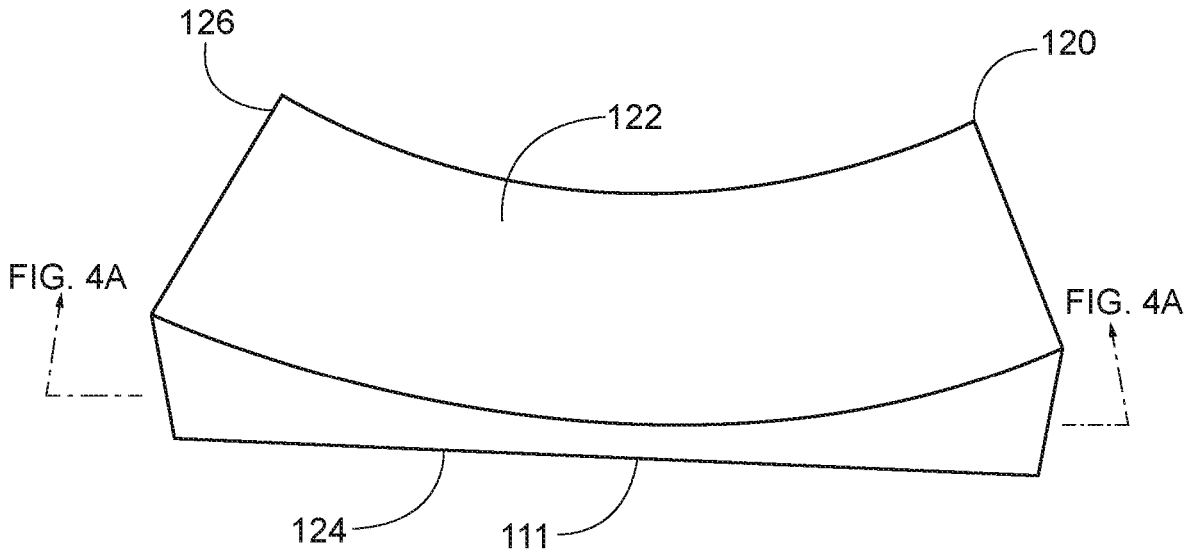
FIG. 4 depicts a perspective view of a low friction material according to another alternative exemplary embodiment of the present invention.
Figure 4A:
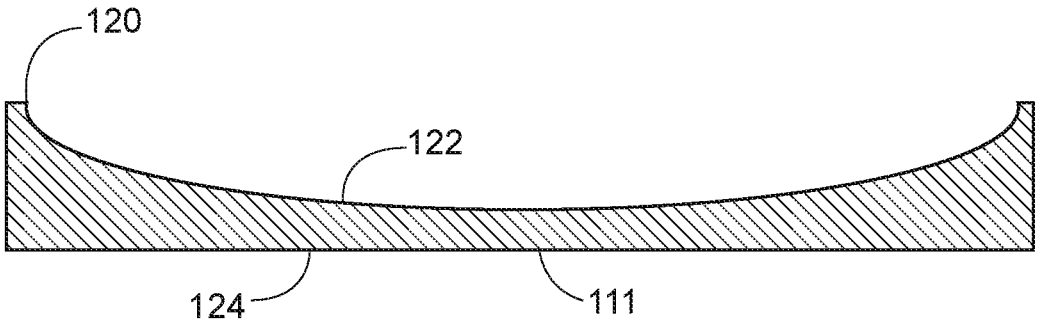
FIG. 4A shows a sectional view of FIG. 4 taken along lines 4A-4A of FIG. 4.

The primary component of this invention is a piece of reduced friction material, such as UHMWPE, as illustrated by reduced friction pad 100 shown in FIG. 1, a reduced friction pad 110 shown in FIGS. 3 and 3A, and a reduced friction pad 111 shown in FIGS. 4 and 4A.

Any of pad 100, 110, 111 is attached to the underside 210 of a skateboard 200, just above each of the four wheels 220 on skateboard 200 such that, when a rider leans on an edge of skateboard 200, pushing bottom surface 210 of skateboard 200 toward at least one of wheels 220, the reduced friction pads 100, 110, 111 of the present invention engage the at least one wheel 220. The low coefficient of friction between the pad 100, 110, 111 and the at least one wheel 220 prevents wheel bite, and allows the at least one wheel 220 to continue rolling and not lock up, potentially causing the rider to crash.

Figure 2:
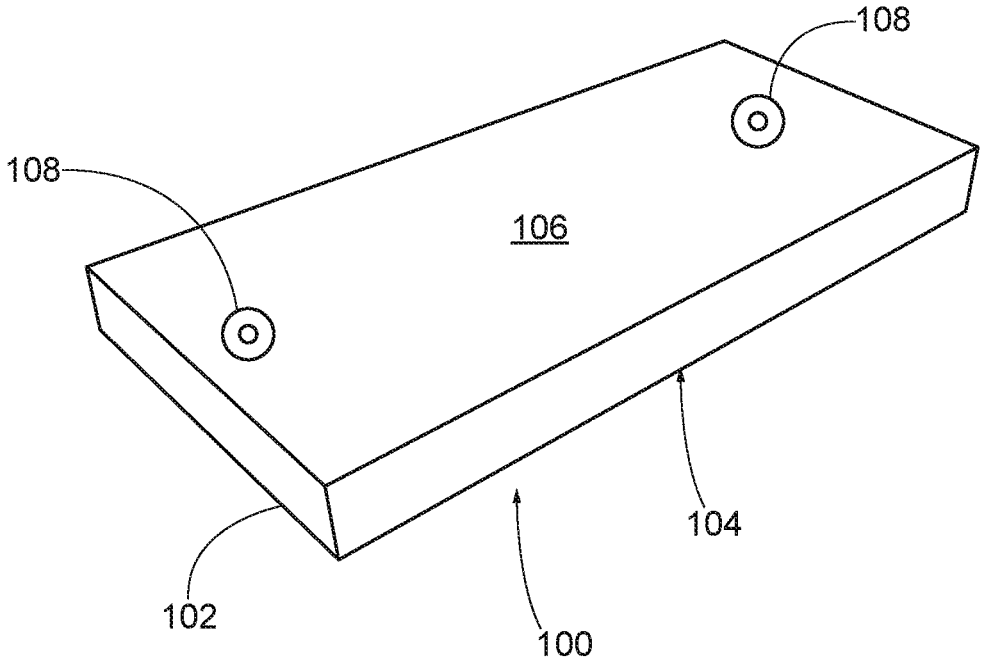
FIG. 2 depicts a perspective view of a low friction material according to an exemplary embodiment of the present invention.

Referring to FIG. 2, pad 100 includes a generally parallelepiped body 102 comprising a planar attachment face 104 and a wheel engaging face 106 disposed distal of the attachment face 102. Wheel engaging face 106 is generally planar in shape. In an exemplary embodiment, the dimensions of the pad 100 can be between about 1 and about 3 inches in length, between about 0.5 and about 1.5 inches in width, and less than or equal to 0.5 inches in thickness.

Figure 2A:
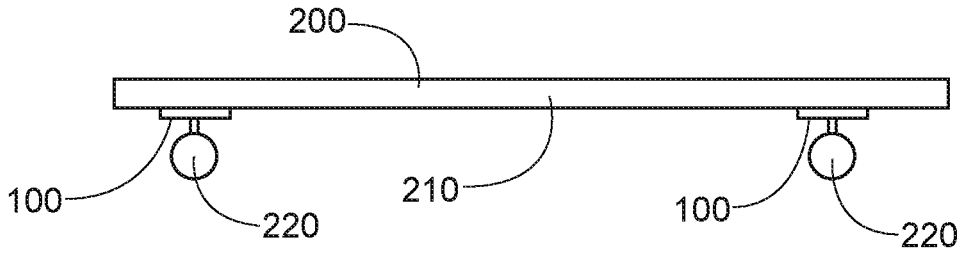
FIG. 2A depicts a side elevational view of a skateboard with the low friction material of FIG. 2 attached thereto.
Figure 2B:
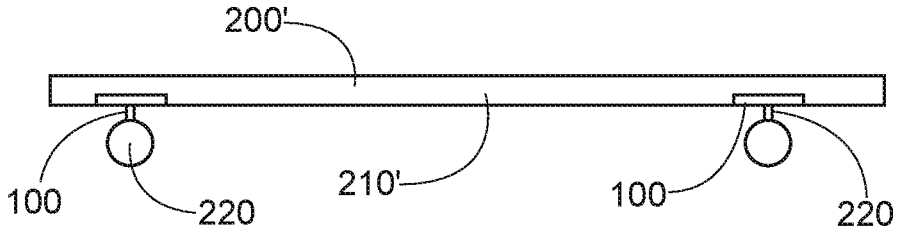
FIG. 2B a side elevational view of an alternative embodiment of a skateboard with the low friction material of FIG. 2 attached thereto.

FIG. 2A shows pad 100 attached to underside 210 of skateboard 200 between the underside 210 and the wheels 220. FIG. 2B shows pad 100 attached to underside 210 of a skateboard 200' in which pad 100 extends into underside 210' between underside 210' and the wheels 220.

Referring to FIGS. 3 and 3A, pad 110 includes a generally parallelepiped body 115 comprising a planar attachment face 113 and a wheel engaging face 116 disposed distal of attachment face 113. A concave cavity 118 is formed in wheel engagement face 116. Cavity 118 is generally non-planar, parabolic in shape and is sized to allow wheel 220 to roll within cavity 118. In an exemplary embodiment, cavity 118 is larger than the diameter of wheel 220 such that cavity 118 is sized to allow wheel 220 to roll within cavity 118.

Referring to FIGS. 4 and 4A, pad 111 includes a generally parallelepiped body 120 comprising a planar attachment face 124 and a wheel engaging face 126. A concave cavity 122 is formed in wheel engagement face 126. Cavity 126 has a generally arcuate shape in a longitudinal direction. In an exemplary embodiment, cavity 126 is larger than the diameter of wheel 220 such that cavity 126 is sized to allow wheel 220 to roll within cavity 126.

In an exemplary embodiment, the reduced friction material from which pads 100, 110, 111 are constructed has a coefficient of friction of less than about 0.15. An exemplary grade of UHMWPE can be Tyvar® DrySlide, which has a coefficient of friction of about 0.08 relative to polyurethane, which is a common material used for fabricating wheels 220. In an exemplary embodiment, the coefficient of friction is between about 0.08 and about 0.15 relative to polyurethane. Those skilled in the art, however, will recognize that wheels 220 can be constructed from a different material. However, the coefficient of friction between such other material and pads 100, 110, 111 will still be lower than the coefficient of friction between the other material and the underside 210 of a skateboard 200.

Figure 5:
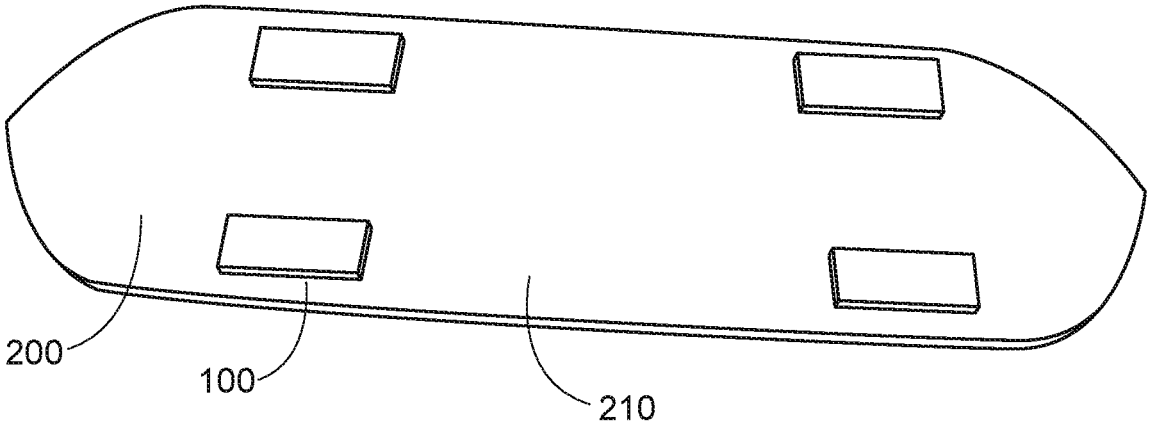
FIG. 5 shows a perspective view of the pad of any of FIG. 2, 3, or 4 attached to the underside of a skateboard.
Figure 6:
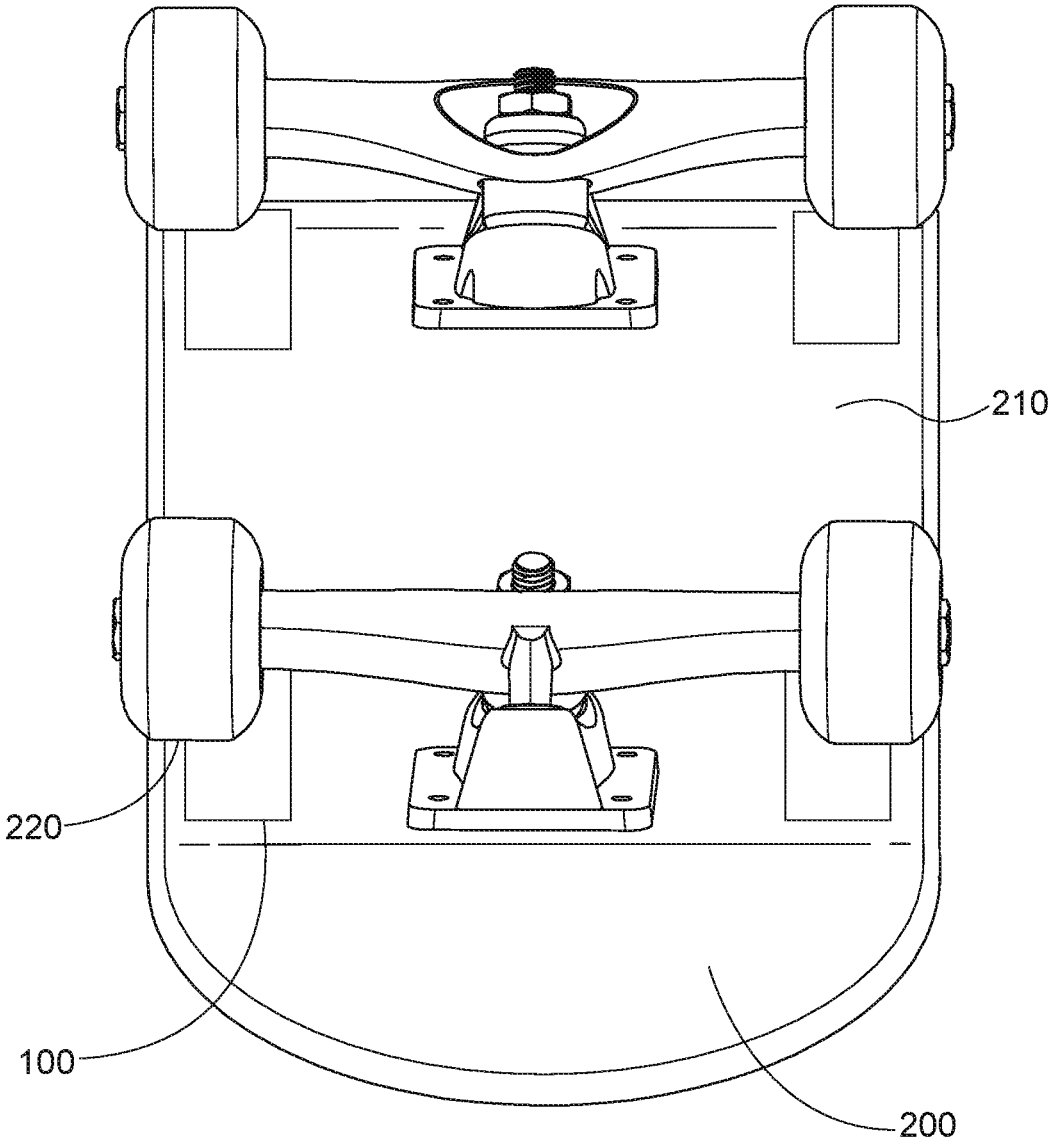
FIG. 6 shows a perspective view of the pad of any of FIG. 2, 3, or 4 located between the underside of the skateboard of FIG. 5 and wheels on the skateboard.
Figure 7:
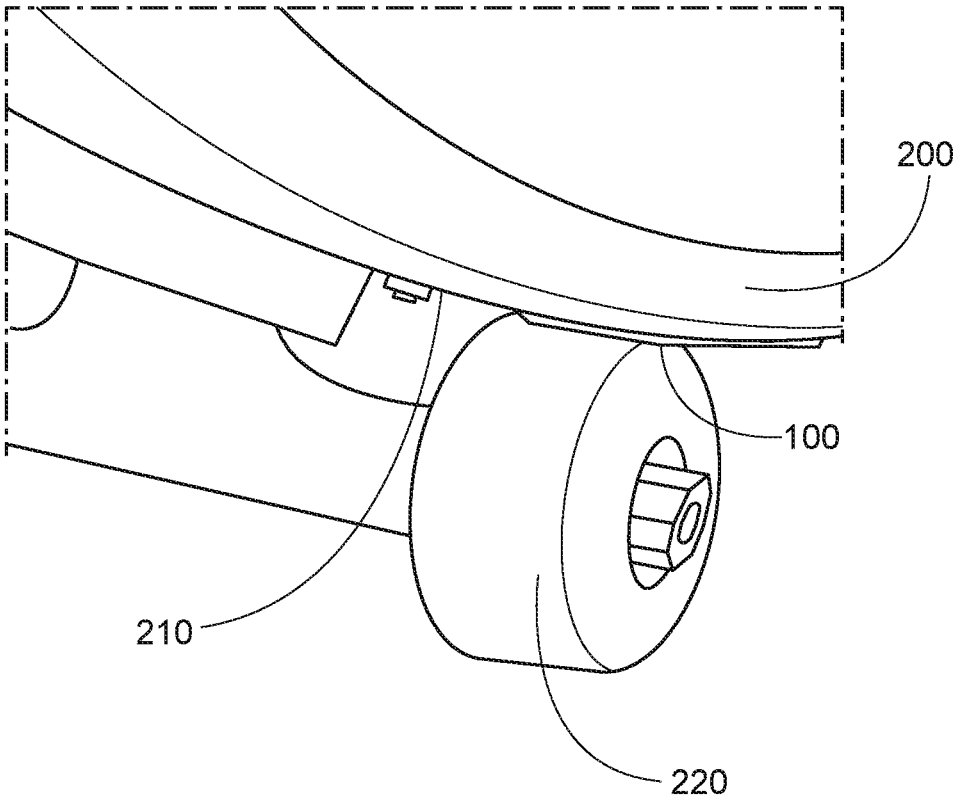
FIG. 7 shows an exemplary embodiment of a wheel of the skateboard of FIG. 6 engaging one of the pads of any of FIG. 2, 3, or 4

The application of placing any of pads 100, 110, 111 on the underside 210 of a skateboard 200 between the underside 210 of the skateboard 200 and the wheels 220 in order to reduce friction to reduce or eliminate wheel bite, as demonstrated in FIGS. 6 and 7. FIG. 5 shows the approximate positioning of reduced friction pad 100 on the underside 210 of skateboard 200.

With respect to pad 110, the material that defines cavity 118 can have a lower coefficient of friction relative to wheels 220 than the remainder of pad 110. Similarly, with respect to pad 111, the material that defines arcuate cavity 122 can have a lower coefficient of friction relative to wheels 220 than the remainder of pad 111.

Any of pads 100, 110, 111 can be secured to skateboard 200 in a number of ways. FIG. 2 shows pad 100 having a pair of spaced part through-openings 108. Through openings 108 can accommodate screws (not shown) that can be used to removably secure pad 100 to the underside 210 of skateboard 200. Alternatively, as shown in FIG. 3A with respect to pad 110, an adhesive can be applied to attachment face 113 of pad 110. If pad 110 is provided separately from skateboard 200, a flexible sheet 114 can be provided to cover adhesive 112 until a user is ready to attach pad 110 to skateboard 200. In that event, flexible sheet 114 can be peeled away, exposing the adhesive 112.

As demonstrated in FIG. 7, in the very common experience of wheel bite, the wheels 220 will come into contact with reduced friction surface 100 instead of the underside 210 of a skateboard 200. The low-friction properties of polymers such as UHMWPE, when applied between the underside 210 of a skateboard 200 and wheels 220, decreases the effect of the wheel bite. In addition, the high-abrasion resistance properties of polymers such as UHMWPE allow the reduced friction surface 100 to withstand significant wear, making it an effective and durable solution to the problem of wheel bite.

Although this invention has been described in specific detail and examples with reference to exemplary embodiments, it will be understood that variations and modifications may be effected within the spirit and scope of the invention, which are intended to be covered by the following claims.

What is claimed is:

1. A low-friction pad that is applied between a bottom surface of a skateboard and a wheel of the skateboard to reduce the effects of wheel bite, the pad comprising:

a body comprising:

a planar attachment face; and a wheel engaging face disposed distal of the attachment face, wherein the body has a through hole extending therethrough between the wheel engaging face and the attachment face.

2. The pad according to claim 1, wherein the wheel engagement face comprises a generally concave cavity.

3. The pad according to claim 1, further comprising an adhesive applied to the attachment face.

4. The pad according to claim 3, further comprising a flexible sheet releasably attached to the adhesive.

5. The pad according to claim 1, wherein the wheel engaging face comprises a planar surface.

6. The pad according to claim 1, wherein the pad is adapted to be located between a bottom surface of a skateboard and a wheel of the skateboard.

7. The pad according to claim 1, wherein the wheel engaging face has a coefficient of friction of about 0.15 relative to polyurethane.

8. The pad according to claim 1, wherein the wheel engagement face has a lower coefficient of friction relative to polyurethane than a remainder of the pad.

9. The pad according to claim 1, wherein the wheel engagement face has the same coefficient of friction relative to polyurethane as a remainder of the pad.

10. A skateboard assembly comprising:

a skateboard comprising:

a board having a top surface and a bottom surface, distal from the top surface; and a plurality of wheels extending downwardly from the bottom surface; and a low friction pad disposed between the bottom surface and at least one of the plurality of wheels, the pad having an attachment face attached to the board and a wheel engaging face disposed distal of the attachment face directly above the at least one wheel, wherein the pad extends into the board.

11. The skateboard assembly according to claim 10, wherein the at least one wheel is pivotable to engage the wheel engaging face.

12. The skateboard assembly according to claim 10, wherein the wheel engagement face has an arcuate cutout having a radius larger than a radius of each of the plurality of wheels.

13. The skateboard assembly according to claim 10, wherein the wheel engaging face has a coefficient of friction of about 0.15 relative to the wheels.

14. The skateboard assembly according to claim 10, wherein the attachment face is attached to the bottom surface of the board.

15. The skateboard assembly according to claim 14, wherein the attachment face is adhesively attached to the bottom of the board.

16. A skateboard assembly comprising:

a skateboard comprising:

a board having a top surface and a bottom surface, distal from the top surface; and a plurality of wheels extending downwardly from the bottom surface; and a low friction pad disposed between the bottom surface and at least one of the plurality of wheel, the pad having an attachment face attached to the board and a wheel engaging face disposed distal of the attachment face directly above the at least one wheel, wherein the wheel engaging face has a non-planar profile.

17. The skateboard assembly according to claim 10, wherein the pad is removably attached to the board.

* * * * *